US006217018B1

(12) United States Patent
Tay et al.

(10) Patent No.: US 6,217,018 B1
(45) Date of Patent: Apr. 17, 2001

(54) SHEET FEED MECHANISM

(75) Inventors: See Yek Tay; Ah Chong Johnny Tee; Ching Yong Chua, all of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/360,300

(22) Filed: Jul. 22, 1999

(51) Int. Cl.[7] ..... B65H 1/00
(52) U.S. Cl. ..... 271/145; 271/162; 271/213
(58) Field of Search ..... 271/4.08, 113, 271/116, 117, 145, 162, 163, 164, 212, 213

(56) References Cited

U.S. PATENT DOCUMENTS 5,370,380 * 12/1994 Suzuki et al. ..... 271/121 X
5,485,991 * 1/1996 Hirano et al. ..... 271/121 X
5,527,026 * 6/1996 Padget et al. ..... 271/117 X
5,547,181 * 8/1996 Underwood ..... 271/114 X
5,669,601 * 9/1997 Fisher ..... 271/117 X
5,951,180 * 9/1999 Kawaura ..... 271/114 X
6,082,002 * 7/2000 Belon et al. ..... 29/895.3 X

* cited by examiner

*Primary Examiner*—Joseph E. Valenza
*Assistant Examiner*—Gene O. Crawford

(57) ABSTRACT

A sheet feed mechanism for feeding sheet media in a printing device. The mechanism comprises a slidably retractable tray accommodating a stack of sheet media, and a pick mechanism including a friction roller for picking individual sheets from the stack of sheet media and advancing the sheets along a media path. The pick mechanism is configured such that in use the friction roller applies a compression force on the stack of sheet media to increase the friction force between the friction roller and the top sheet of the stack. When the stack of media is exhausted, the friction roller applies a compression force directly on the tray floor. In order to prevent the friction roller from being dragged around as the tray is retracted, the tray floor includes a ridged surface in a region where the friction roller applies the compression force. The ridged surface also helps to remove paper fragments attached to the friction roller.

9 Claims, 9 Drawing Sheets

SHEET FEED MECHANISM

FIELD OF INVENTION

This invention relates to a sheet feed mechanism for feeding sheet media in a printing device.

BACKGROUND OF THE INVENTION

In printing devices, such as computer printers and plain-paper fax machines, a sheet of media (e.g. paper, transparencies) is transported from an input tray to a printing engine where the sheet receives graphic or text markings. The sheet is then transported into an output tray.

FIG. 1 illustrates a known type of sheet feed mechanism 5. The input tray 10 accommodates a stack of sheet media 12, and a pick mechanism comprising a friction roller 14 is employed to pick individual sheets from the stack and advance the sheets along a media path 16. To effectively transport a media sheet, it is desirable that the sheet does not slide relative to the friction roller 14 surface. It is also desirable that individual sheets be transported in series rather than being one of multiple overlapping sheets. To avoid sliding and multiple-sheet picking, the pick mechanism is configured so that the friction roller applies a normal force N to the media.

The normal force of the friction roller on the media may be achieved by spring-loading the friction roller, or by allowing the weight of the friction roller to act directly on the stack. With the normal force applied, a drive motor rotates the friction roller in an anti-clockwise direction to pick and advance the top-most sheet of the stack. A gear mechanism may be employed to couple the drive motor to the friction roller.

Some friction rollers have a continuous elastomeric surface contacting the media along the roller length. Other friction rollers may include several elastomeric surfaces in parallel (e.g. "tyres") along the roller length. The friction roller preferably has a high friction surface. To achieve a high friction surface, it is desirable to provide a high coefficient of friction (COF) between the roller and the media sheet. Factors affecting the COF include the base material of the roller surface, adjunct materials added to or modifying the base material, the finish of the surface, and cleaning chemicals applied to the surface during its useful lifetime. A drawback with the friction roller is that over time the COF reduces due to paper fibres, dirt and other contaminants interacting with the roller surface.

FIG. 2 illustrates the sheet feed mechanism of FIG. 1 with the stack of media exhausted. The media stack may be replenished by manually sliding out the tray 10 in a direction B, adding a fresh stack of paper, and sliding the tray back to its operational position. The replenishing process has a drawback due to the floor of the tray dragging against the friction roller as the tray is slid out. This dragging action forces the friction roller in a clockwise direction opposite to the normal anti-clockwise pick direction of the roller, which in turn can result in permanent damage to the drive motor or the gear mechanism. Sometimes, the dragging action can be so strong as to strip the teeth from the gears of the gear mechanism.

In an attempt to solve the problem of the tray floor dragging against the roller, a known sheet feed mechanism includes a withdrawing mechanism which simultaneously lifts or withdraws the friction roller away from the sheet stack as the tray is withdrawn. However, the applicant has found in practice that users frequently remove the in-tray at excessive speeds, sometimes in order to replenish the media stack before the printer signals a "paper out" error. In these situations, the inertia of the withdrawing mechanism prevents the friction roller from being lifted quickly enough to avoid the dragging action of the tray floor. Accordingly, the motor and gear mechanism can still be damaged. Sometimes, the frictional force produced by the dragging action of the tray floor can actually hold the roller in place against the withdrawing action of the mechanism.

SUMMARY OF THE INVENTION

According to the present invention, there is provided a sheet feed mechanism for feeding sheet media in a printing device, comprising a slidably retractable tray having a floor for supporting a stack of sheet media, and a pick mechanism including a friction roller for picking individual sheets from the stack of sheet media and advancing the sheets along a media path, the pick mechanism being configured such that in use the friction roller applies a compression force on the stack of sheet media to increase the friction force between the friction roller and the top sheet of the stack, whereby upon the stack of media being exhausted, the friction roller applies a compression force directly on the tray floor, characterised in that the tray floor includes a surface adapted to reduce the coefficient of friction between the friction roller and said surface in a region where the friction roller applies the compression force.

A sheet feed mechanism in accordance with the invention has the advantage that compared to existing sheet feed mechanisms, the adapted surface of the tray floor provides a reduced coefficient of friction between the friction roller and the tray floor. This reduced coefficient of friction decreases the frictional force between the tray and the friction roller when the media is exhausted. Thus the drive motor or the gear mechanism are less likely to become damaged if the tray is retracted.

Ideally, the adapted surface of the tray floor is knurled and includes a series of peaks and troughs. Preferably, the adapted surface is ridged with the ridges running in the direction of the friction roller.

A sheet feed mechanism in accordance with the invention also has the advantage that the peaks and troughs in said region of the tray floor provide a suitable abrasive surface for removing paper fibres, dirt and other contaminants built up on the friction roller. This abrasive surface acts on the friction roller as the tray is retracted. Thus, the adapted surface can further restore the high friction surface to the friction roller during operation of the printing device.

Ideally, the tray is slidably retractable from the printer device and the pick mechanism. The sheet media is preferably advanced in a direction generally opposite to the direction in which the tray may be retracted.

In a preferred embodiment, the pick mechanism includes a withdrawing mechanism that releases the compression force of the drive roller as the tray is retracted. Suitably, the pick mechanism includes a drive motor coupled to the friction roller. The pick mechanism may also include a gear mechanism that couples the drive motor and the friction roller. The gear mechanism may comprise a worm gear, and a clutch which decouples the friction roller and the drive motor in the non-pick direction of relative rotation between the friction roller and the drive motor.

In a first embodiment, the ridged surface has a saw-tooth like profile. In a second embodiment, the ridged surface has a triangle-wave like profile. In a third embodiment, the ridged surface has a square-wave like profile.

Ideally, the sheet feed mechanism is incorporated in a printing device, such as a computer printer or a plain-paper fax machine.

DETAILED DESCRIPTION OF A PREFERRED EMBODIMENT

Figure 1:
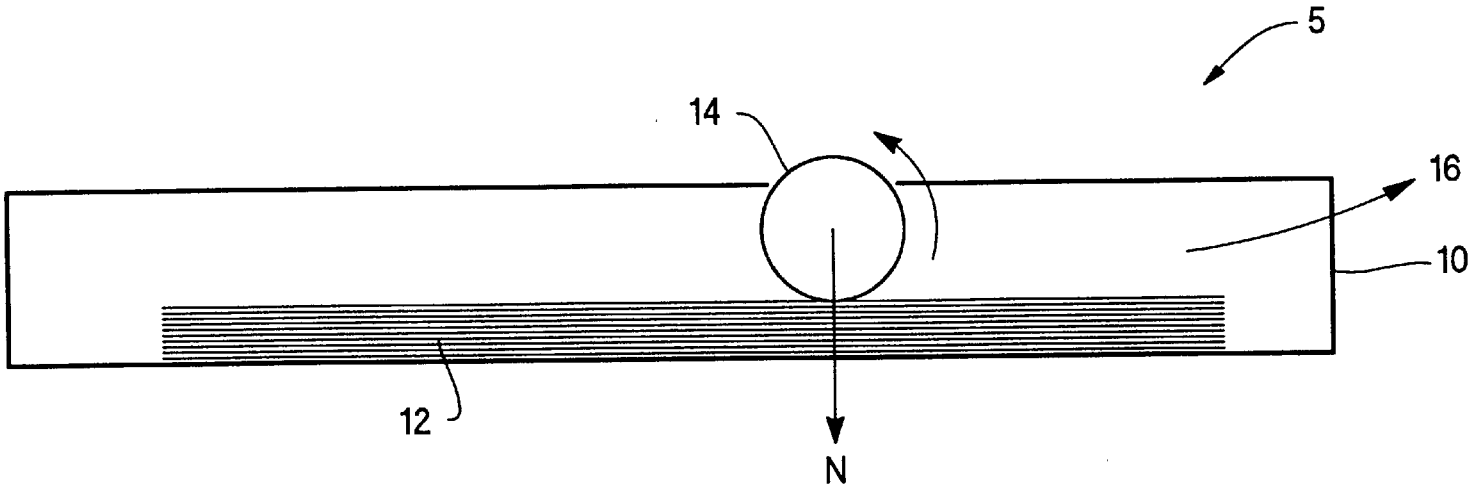
FIG. 1 is a side view of a known type of sheet feed mechanism.
Figure 2:
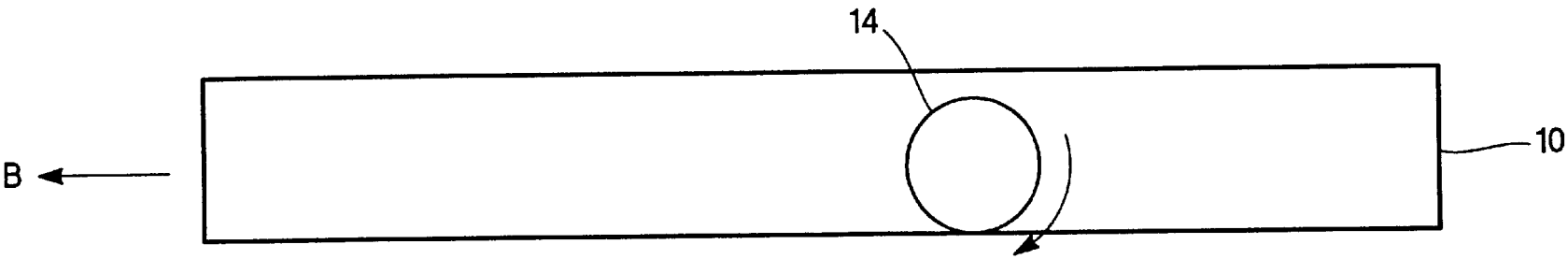
FIG. 2 is a side view of the sheet feed mechanism of FIG. 1, with the stack of media exhausted.
Figure 3:
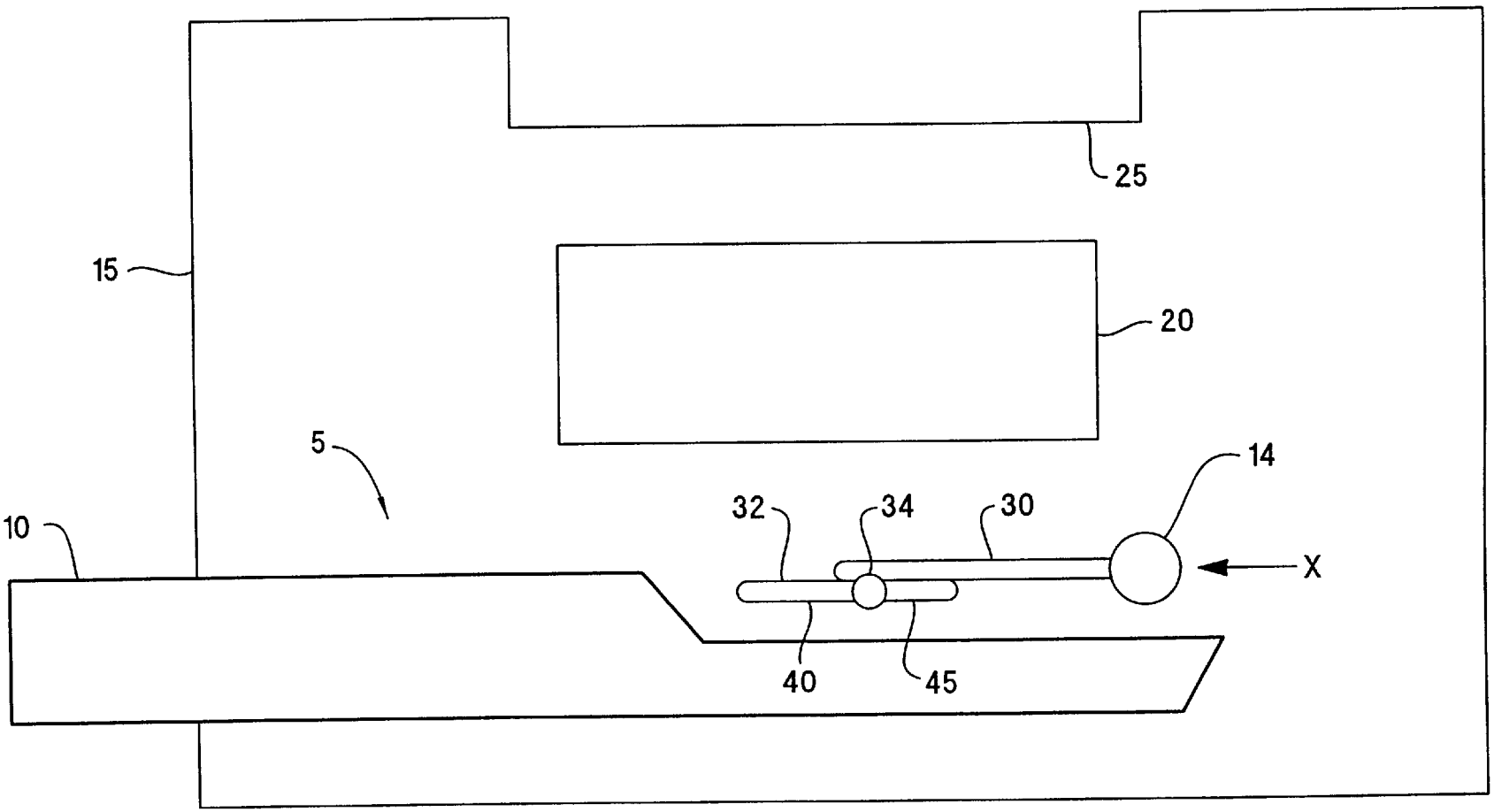
FIG. 3 is a side view of a printing device including a sheet feed mechanism in accordance with the invention, with the paper tray partly inserted and the friction roller fully withdrawn.

Referring to FIG. 3, there is shown a computer printer 15 which may be connected to a computer in order to receive print data for generating graphics and/or text on sheets of print media e.g. paper.

The computer printer 15 comprises a generally rectangular housing made, for example, of a plastics material enclosing a print engine 20. The top of the housing includes a rectangular recess 25 which provides an output tray for paper sheets processed by the print engine 20. Towards the base of the housing, on one of the side walls, the housing includes an opening or slot for slidably receiving an input tray 10. The input tray can accommodate a stack of paper sheets and forms part of a sheet feed mechanism 5 for feeding sheets of paper to the print engine 20.

Figure 6:
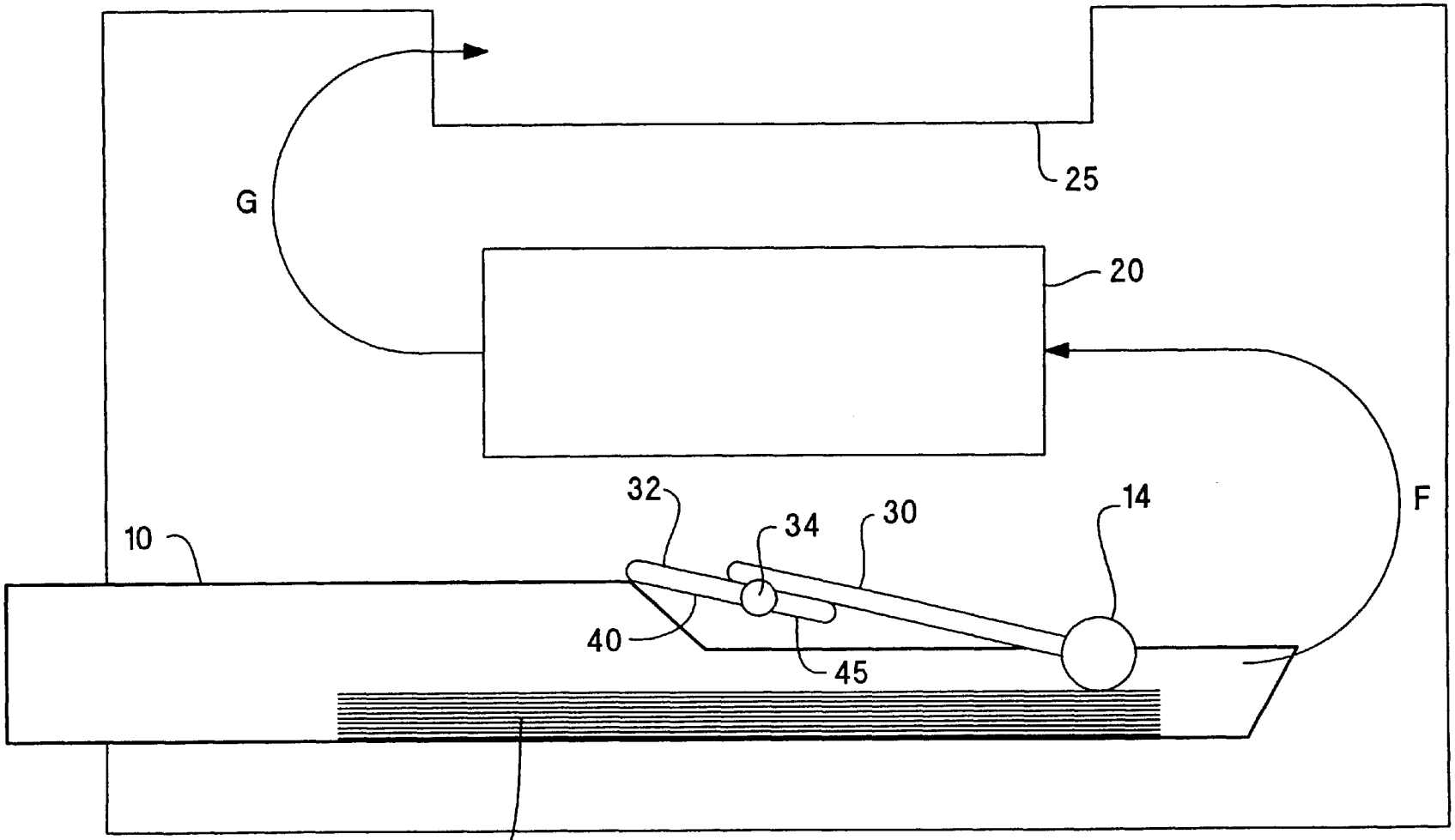
FIG. 6 is a side view of the printing device of FIG. 3, with the paper tray fully inserted and the friction roller acting against a stack of paper.

Referring also to FIG. 6, the process of printing involves firstly advancing individual sheets of paper along an input path (arrow F) to the print engine 20. Secondly, the print engine generates print images on the individually received sheets of paper. Thirdly, the processed sheets of paper are fed along an output path (arrow G) to the output tray 25.

To pick and advance individual sheets of paper, the sheet feed mechanism 5 includes a pick mechanism comprising a friction roller 14 located on the end of a pivoting arm 30. The pick mechanism further includes a pivoting lever 32 with a first arm 40 for acting on the input tray 10, and a diametrically opposed but axially offset second arm 45 for acting against the pivoting arm 30. The arm 30 and the lever 32 are independently mounted on a common axle 34. The lever 32 is biased about the axis of the axle 34 in an anti-clockwise direction in FIGS. 3 to 6. This biasing may be provided in a known fashion by, for example, a coiled axle spring. The pivoting lever forms part of a withdrawing mechanism for raising and lowering the friction roller 14 depending on the position of the input tray 10.

With the input tray retracted, as shown in FIG. 3, the arm 30 and hence the friction roller 14 are held in a fully withdrawn or raised position by the second arm 45 of the lever 32. The top edge of the second arm 45 abuts the lower edge of the arm 30 in this position, and transfers the anticlockwise biasing force to the arm 30. Meanwhile, the top edge of the arm 30 abuts a stop (not shown) preventing the arm from being raised further by the biasing force.

Figure 4:
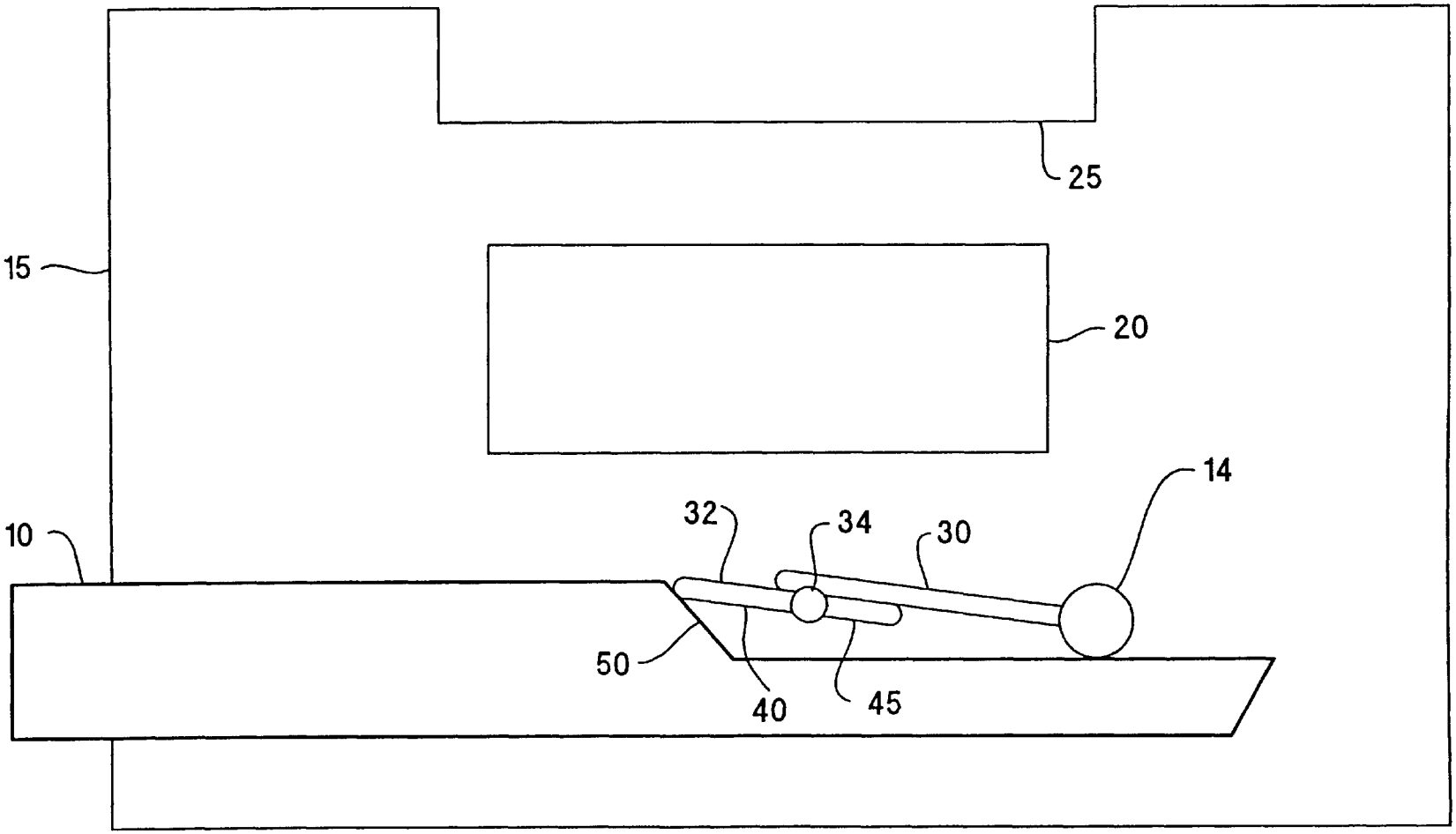
FIG. 4 is a side view of the printing device of FIG. 3, with the paper tray partly inserted and the friction roller partly withdrawn.

Referring to FIG. 4, as the input tray is inserted into the printer 15, a ramped section 50 on a side wall of the tray abuts the end of the first arm 40 forcing the lever 32 in a clockwise direction about the axle 34 against the biasing action of the lever. The arm 30 rests on the second arm 45 of the lever under its own weight and the weight of the friction roller. Thus, as the lever 32 is rotated in the clockwise direction by the tray, the arm 30 is also rotated clockwise to lower the friction roller 14.

Figure 5:
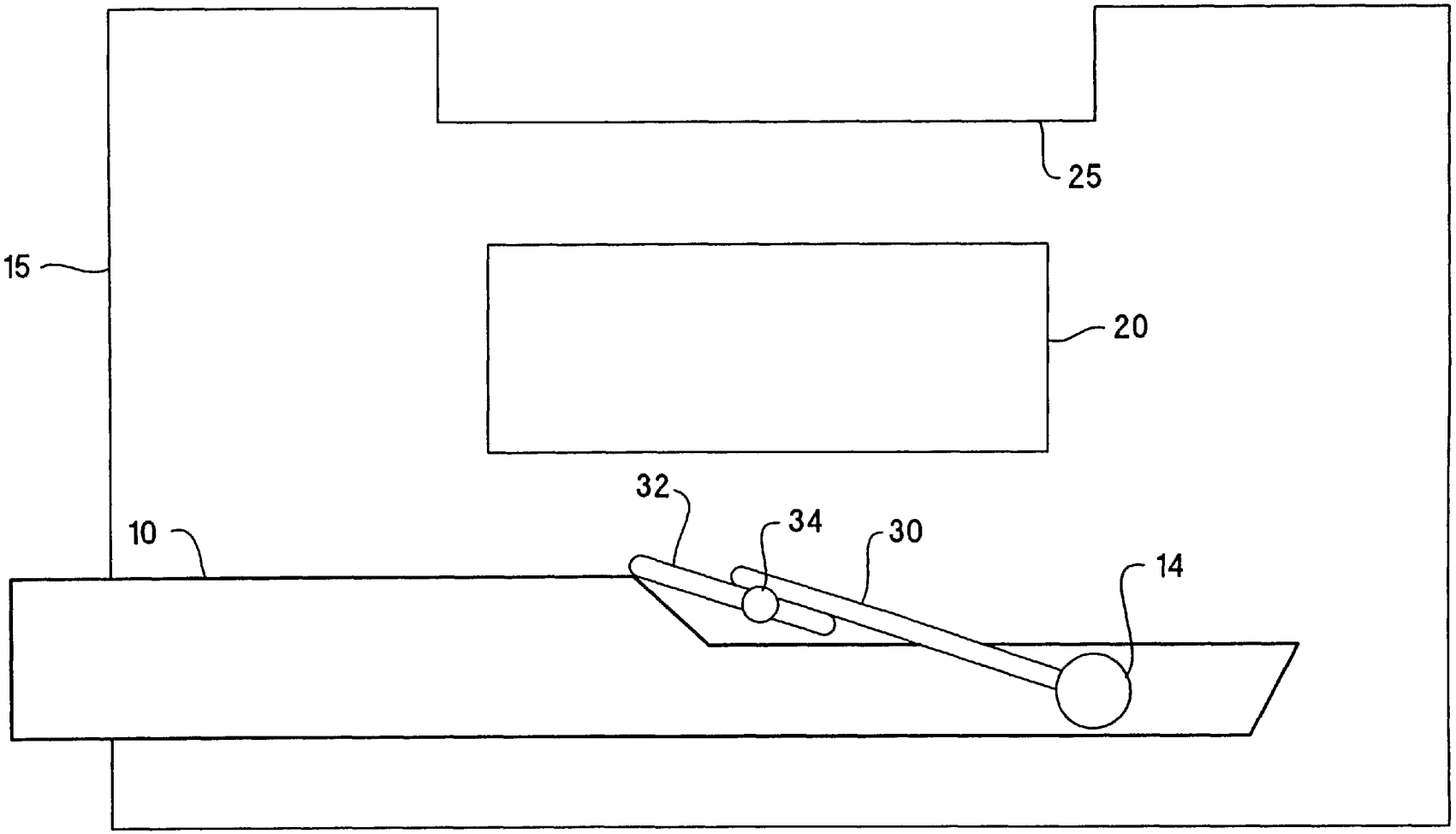
FIG. 5 is a side view of the printing device of FIG. 3, with the paper tray fully inserted and the friction roller acting against the tray floor.

Once the input tray has been fully inserted into its seated position in the printer 15, the friction roller is lowered so as to rest on the tray floor as shown in FIG. 5.

During normal operation, the input tray will contain a stack of paper sheets as shown in FIG. 6. The stack 12 is positioned to lie in the path of the friction roller as it is lowered onto the tray floor. Consequently, with the stack present the friction roller rests instead on the top sheet of the stack of paper sheets.

When it is desired to replenish the paper stack, the tray may be slid out or retracted. Retraction of the tray causes the end of the first arm 40 to cam against the ramped section 50 of the tray so that the lever rotates in a anti-clockwise direction. As the lever rotates, the top edge of the second arm 45 comes into contact with the lower edge of the arm 30. Continued rotation of the lever causes the arm 30 and the friction roller 14 to be lifted back to the raised position shown in FIG. 3.

Figure 7:
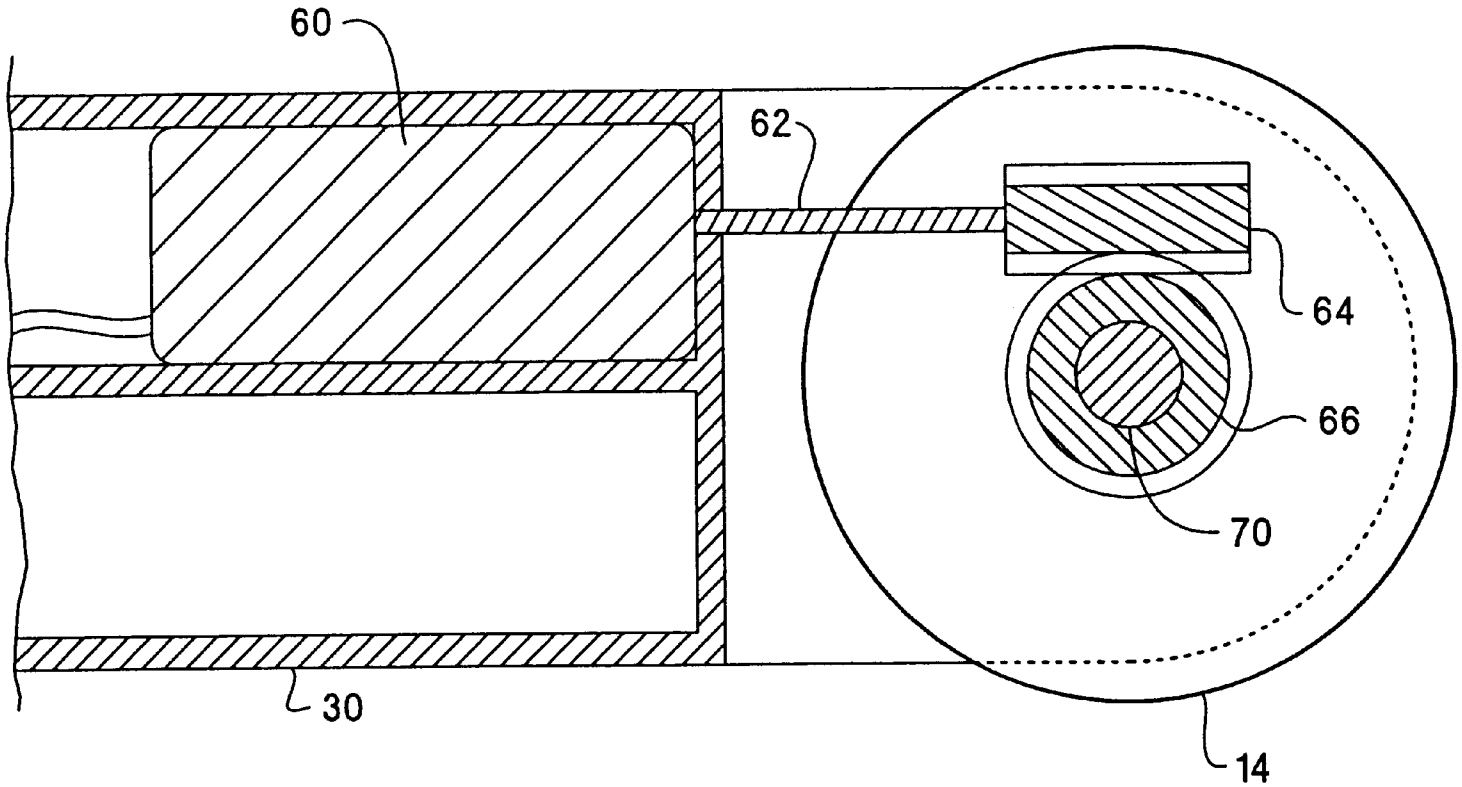
FIG. 7 is a cross-section side view showing a detail of a pick mechanism of the sheet feed mechanism of FIG. 3.
Figure 8:
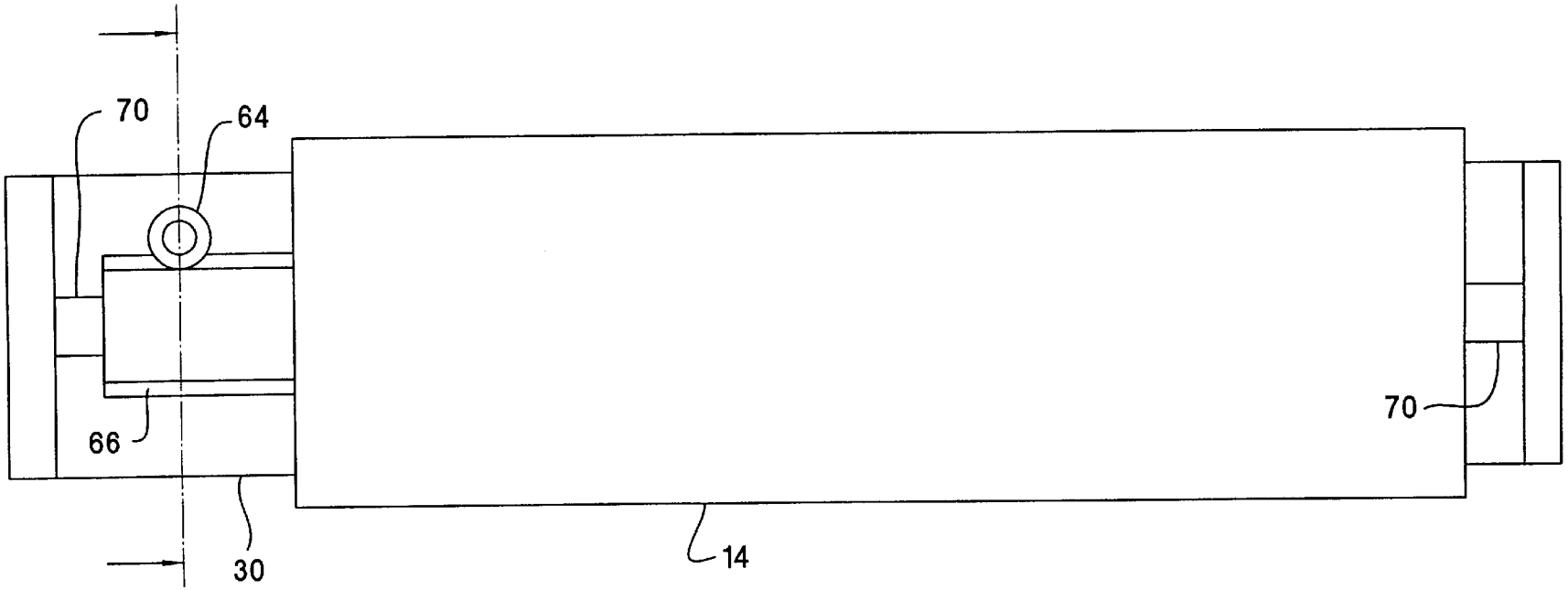
FIG. 8 is an end view of the pick mechanism of FIG. 7.

Reference is now made to FIGS. 7 and 8 which are detailed views of the pick mechanism of FIGS. 3 to 6. In addition to the arm 30 and the friction roller 14, the pick mechanism also includes a drive motor 60 located within a housing of the arm 30. A drive shaft 62 of the drive motor 60 is coupled to the friction roller 14 by a worm gear mechanism comprising a worm 64 and a worm gear 66. The friction roller and the worm gear 66 are mounted on a common axle 70. When the friction roller needs to be driven in the anti-clockwise direction, the drive motor is activated by an electrical voltage supplied via the wires 68 from circuitry in the printer. The worm gear acts to translate the rotation of the drive shaft 62 into anti-clockwise rotation of the axle 70 and the friction roller 14.

As mentioned, the process of printing involves firstly advancing individual sheets of paper along an input path (arrow F) to the print engine 20 (see FIG. 6). The input path may include pinch rollers which grab individual sheets picked from the paper stack by the pick mechanism. It is preferable to deactivate the drive motor once the sheet has been grabbed by the pinch rollers in order to avoid inconsistent advancement of the paper sheets between the different rollers. However, deactivation of the drive motor must not prevent free advancement of the paper sheet along the input path. Accordingly, the worm gear 66 is coupled to the friction roller axle 70 by a clutch (not shown). The clutch permits the friction roller axle 70 to rotate in a anti-clockwise direction whilst the worm gear 66 remains stationary. Conversely, the clutch locks when the worm gear 66 is rotated in an anti-clockwise whilst the axle 70 attempts to be held stationary (e.g. when the paper generates a dragging force on the friction roller). Thus, the clutch allows both the paper sheet to be freely advanced along the input path by the pinch rollers, and the drive motor to drive the friction roller in the anti-clockwise direction to pick paper from the stack. This form of clutch is readily available in the printer field.

Figure 9:
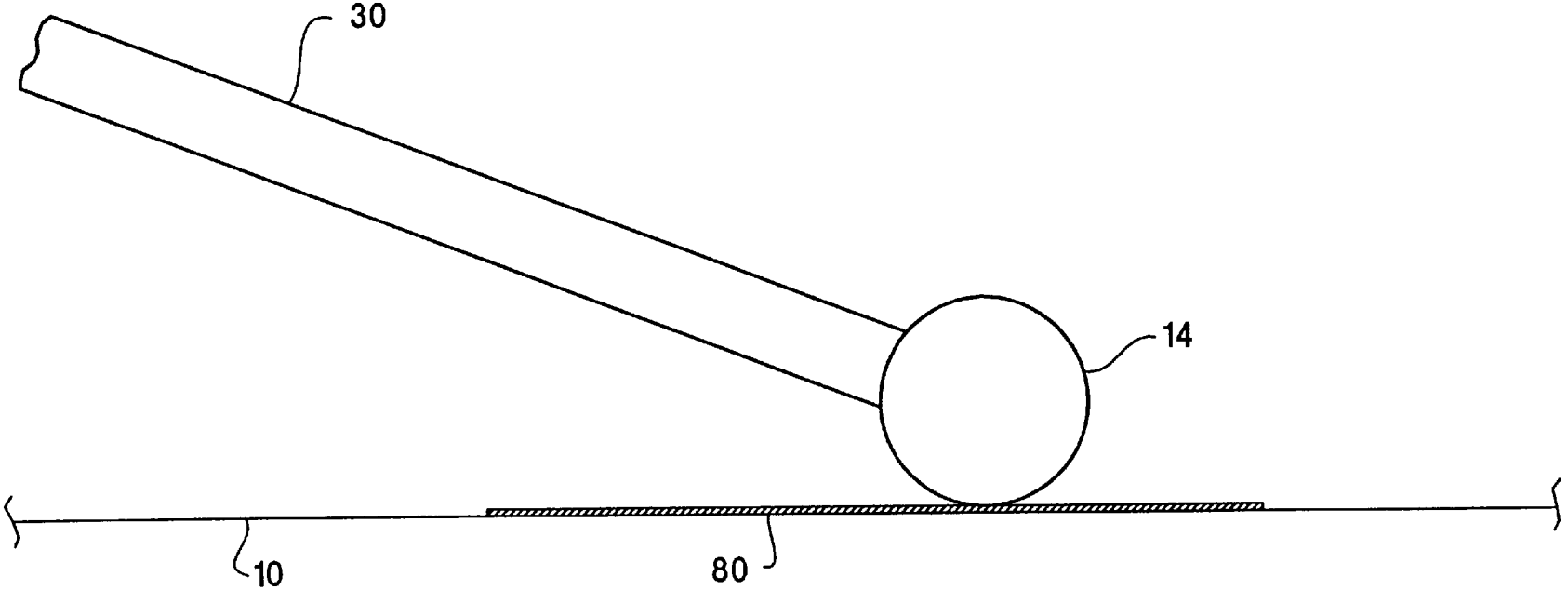
FIG. 9 is a side view showing a detail of the sheet feed mechanism of FIG. 3, including an adapted surface region of the paper tray.

When the friction roller is resting against the input tray floor as shown in FIG. 5, retraction of the tray causes the friction roller to be simultaneously raised. However, a short delay or a small sliding movement of the tray often occurs before the friction roller starts to be raised. During this moment, the smooth tray floor can drag against the friction roller, forcing it to turn in a clockwise direction whilst the worm gear 66 is held stationary by the drive motor. This relative rotation between the friction roller and the worm gear causes the clutch to lock. If the tray is pulled hard enough as it is retracted, the dragging force of the tray floor on the friction roller may be sufficient to strip the teeth of the worm gear. To overcome this problem, the floor of the tray is adapted, as shown in FIG. 9, in the region 80 where the friction roller contacts the tray floor, to reduce the coefficient of friction between the friction roller and the tray floor. The remainder of the tray floor may have a traditional high-friction smooth surface.

Figure 10A:
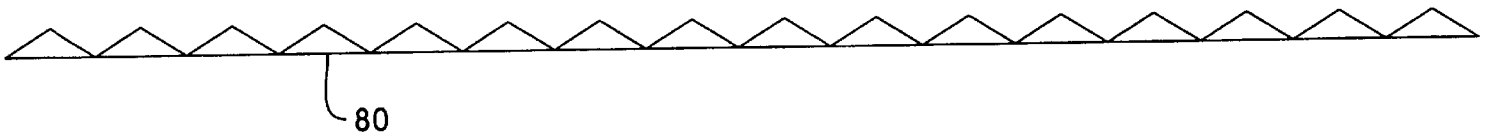
FIGS. 10A, 10B and 10C are side views showing the profile of the adapted surface of the paper tray floor.
Figure 10B:
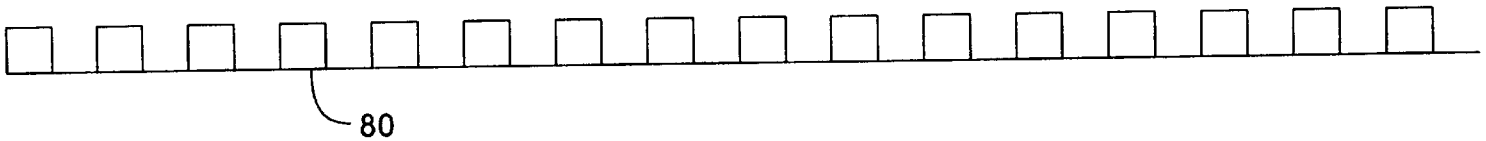
Figure 10C:
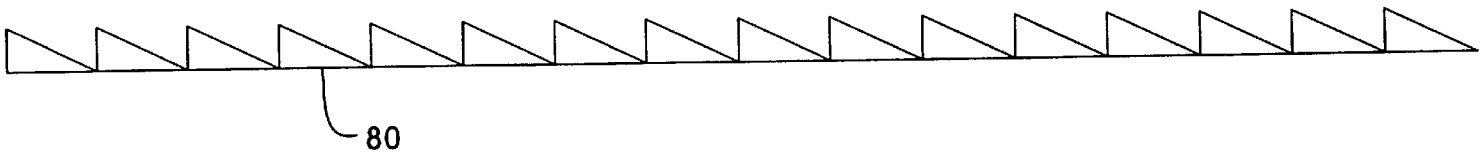

The floor of the tray may be adapted by forming a knurled or ridged surface in the region 80, the general profile being characterised by a series of peaks and troughs. The adapted surface having a ridged appearance may take a variety of forms, all of which include ridges extending generally in the direction of the friction roller. FIGS. 10A, 10B and 10C illustrate preferred examples of the profiles that the ridged surface may form, including a triangle-wave like profile as shown in FIG. 10A, a square-wave like profile as shown in FIG. 10B, and a saw-tooth like profile as shown in FIG. 10C.

As the friction roller is dragged over the ridged surface of the tray, the portion contacting the tray floor is scraped by the sharpened edges of the peaks or ridges. This scraping action has an abrasive effect which scrubs away dirt, paper fibres, and other contaminants built up on the friction roller. The high friction surface of the friction roller is thus gradually restored by the adapted surface of the tray floor. This restored surface is able to pick and advance paper more efficient from a paper stack.

It will be evident in view of the foregoing description that various modifications may be made within the scope of the present invention. For example, the ridges of the adapted surface may have a profile different to that described herein and may include discontinuous ridges which are offset from one another in a lateral direction to the direction in which the ridges extend.

What is claimed is:

1. A sheet feed mechanism for feeding sheet media in a printing device, comprising a slidably retractable tray having a floor for supporting a stack of sheet media, and a pick mechanism including a friction roller for picking individual sheets from the stack of sheet media and advancing the sheets along a media path, the pick mechanism being configured such that in use the friction roller applies a compression force on the stack of sheet media to increase the friction force between the friction roller and the top sheet of the stack, whereby upon the stack of media being exhausted, the friction roller applies a compression force directly on the tray floor, wherein the tray floor includes a surface adapted to reduce the coefficient of friction between the friction roller and said surface in a region where the friction roller applies the compression force such that the friction force between the tray floor and the friction roller when the tray is being slid is reduced.

2. A sheet fed mechanism as claimed in claim 1, further comprising a linkage connected to the friction roller for correlating movements of the friction roller with sliding movements of the tray.

3. A sheet feed mechanism as claimed in claim 2, wherein the linkage includes a pivoting lever with a first arm for acting on the tray, whereby the linkage drives the friction roller in a direction corresponding to the direction at which the tray is being slid.

4. A sheet feed mechanism as claimed in claim 3, wherein the linkage further includes a pivoting arm on an end of which the friction roller is located, the pivoting arm and the pivoting lever being independently mounted on a common axis, the pivoting lever further including a diametrically opposed but axially offset second arm for acting against the pivoting arm.

5. A sheet feed mechanism for feeding sheet media in a printing device, comprising:

a slidably retractable tray having a floor for supporting a stack of sheet media, and a pick mechanism including a friction roller for picking individual sheets from the stack of sheet media and advancing the sheets along a media path, the pick mechanism being configured such that in use the friction roller applies a compression force on the stack of sheet media to increase the friction force between the friction roller and the top sheet of the stack, whereby upon the stack of media being exhausted, the friction roller applies a compression force directly on the tray floor, wherein the tray floor includes a ridged surface that reduces the friction force between the friction roller and said surface in a region where the friction roller applies the compression force when the tray is being slid.

6. A sheet feed mechanism as claimed in claim 5, wherein the ridged surface has a saw-tooth like profile.

7. A sheet feed mechanism as claimed in claim 5, wherein the ridged surface has a triangle-wave like profile.

8. A sheet feed mechanism as claimed in claim 5, wherein the ridged surface has a square-wave like profile.

9. A sheet feed mechanism for feeding sheet media in a printing device, comprising a slidably retractable tray having a floor for supporting a stack of sheet media, and a pick mechanism including a friction roller for picking individual sheets from the stack of sheet media and advancing the sheets along a media path, the pick mechanism being configured such that in use the friction roller applies a compression force on the stack of sheet media to increase the friction force between the friction roller and the top sheet of the stack, whereby upon the stack of media being exhausted, the friction roller applies a compression force directly on the tray floor, wherein the tray floor includes a first surface having a first coefficient of friction, and a second surface under the friction roller having a substantially lower coefficient of friction than the first surface for reducing the friction force between the friction roller and the second surface when the tray is being slid.

* * * * *